US006648722B2

(12) United States Patent
Lynders et al.

(10) Patent No.: US 6,648,722 B2
(45) Date of Patent: Nov. 18, 2003

(54) THREE WHEELED WIRELESS CONTROLLED TOY STUNT VEHICLE

(75) Inventors: Michael John Lynders, Shelton, CT (US); James Michael Ferro, Shelton, CT (US); Androc Luther Kislevitz, Ridgewood, NJ (US); Adam Luther Kislevitz, Englewood, NJ (US); Noah Luther Kislevitz, Cresskill, NJ (US)

(73) Assignee: The Obb, LLC, Englewood, NJ (US)

( * ) Notice: Subject to any disclaimer, the term of this patent is extended or adjusted under 35 U.S.C. 154(b) by 0 days.

(21) Appl. No.: 10/231,975

(22) Filed: Aug. 30, 2002

(65) Prior Publication Data

US 2003/0082990 A1 May 1, 2003

Related U.S. Application Data

(60) Provisional application No. 60/340,112, filed on Oct. 26, 2001.

(51) Int. Cl.[7] ..... A63H 17/00

(52) U.S. Cl. ..... 446/437; 446/448; 446/454; 446/465

(58) Field of Search ..... 446/437, 93, 95, 446/431, 442, 443, 448, 454, 456, 457, 460, 461, 465, 466–470

(56) References Cited

U.S. PATENT DOCUMENTS

| | | | | |
|---|---|---|---|---|
| 3,733,739 A | * | 5/1973 | Terzian | 446/462 |
| 3,748,780 A | | 7/1973 | Glass et al. | |
| 4,299,301 A | * | 11/1981 | Janin | 180/6.5 |
| 4,547,166 A | * | 10/1985 | Goldfarb et al. | 446/164 |
| 4,693,696 A | * | 9/1987 | Buck | 446/224 |
| 4,696,655 A | | 9/1987 | D'Andrade et al. | |
| 4,717,367 A | | 1/1988 | Stubenfoll et al. | |
| 4,832,651 A | | 5/1989 | Buck | |
| 5,322,469 A | | 6/1994 | Tilbor | |
| 5,338,247 A | | 8/1994 | Miles | |
| 5,643,041 A | | 7/1997 | Mukaida | |
| 5,667,420 A | | 9/1997 | Menow et al. | |
| 5,667,421 A | | 9/1997 | Uetake | |
| 5,860,846 A | | 1/1999 | Uetake | |
| 5,919,075 A | * | 7/1999 | George et al. | 446/437 |
| 5,921,843 A | | 7/1999 | Skrivan et al. | |
| 5,951,363 A | | 9/1999 | Uetake | |
| 6,193,582 B1 | | 2/2001 | Gleim | |

FOREIGN PATENT DOCUMENTS

| | | | |
|---|---|---|---|
| WO | WO 00/07681 A1 | | 2/2000 |
| WO | WO 0007681 | * | 2/2000 |

OTHER PUBLICATIONS

Mattel 1998 CD ROM Catalog, cover and p. 66, Mattel, Inc. El Segundo, CA.

* cited by examiner

*Primary Examiner*—Derris H. Banks
*Assistant Examiner*—Bena B. Miller
(74) *Attorney, Agent, or Firm*—Akin, Gump, Strauss, Hauer & Feld, L.L.P.

(57) ABSTRACT

A three wheeled wireless controlled toy stunt vehicle capable of both highly elastic impact and less elastic impact with obstacles struck while the vehicle is in motion is disclosed. Two wheels are separately driven, and have tires with interiors that are vented to atmosphere. The third wheel has a tire with an interior that is sealed and pressurized. The pressurized tire is capable of highly elastic impact when it strikes obstacles while the toy vehicle is in motion. The non-pressurized tires are characterized by a less elastic impact with obstacles. The third wheel has a diameter that is larger than a diameter of the drive wheels. All components of the vehicle are contained within the two planes tangent to the three wheels, such that the toy vehicle may be operated on either of its two major sides.

9 Claims, 6 Drawing Sheets

THREE WHEELED WIRELESS CONTROLLED TOY STUNT VEHICLE

CROSS-REFERENCE TO RELATED APPLICATIONS

This application claims benefit of U.S. Provisional Patent Application No. 60/340,112, "Three Wheeled Wireless Controlled Toy Stunt Vehicle", filed Oct. 26, 2001.

BACKGROUND OF THE INVENTION

The present invention relates generally to wheeled toy vehicles, and, more particularly, to wireless controlled two-sided toy vehicles capable of performing stunt maneuvers.

Toy wheeled vehicles are well-known. Toy vehicles, like the full-sized vehicles they often replicate, typically have a top side with a vehicle body portion and a bottom side with wheels, and generally are capable of operation only when the top portion is oriented upwards. Toy vehicles often flip over during play activities, and the user must interrupt his or her play to upright the vehicle. It is thus advantageous for a toy vehicle to be capable of operation with either its "top" or "bottom" side in the upright position. The prior art does disclose vehicles capable of operating with either of the vehicle's two sides oriented upwards. Specifically, U.S. Pat. No. 5,667,420, incorporated by reference herein in its entirety, discloses a six wheeled wireless controlled toy stunt vehicle in which the six wheels are sized and positioned around the vehicle chassis in a way such that the vehicle chassis is fully surrounded by the wheels and is capable of operating on any adjoining two pairs of the wheels. U.S. Pat. Nos. 5,887,985, 5,919,075, and 6,095,890, incorporated by reference herein in their entireties, all disclose a four wheeled wireless controlled toy stunt vehicle in which the four wheels are positioned at the corners of the vehicle chassis and are of such a size that the outer perimeters of the wheels define a volume fully enclosing the remainder of the toy vehicle so that the vehicle can operate on either of two major sides.

Children at play with toy vehicles like those described in the above-identified patents are prone to crash such toy vehicles into obstacles. A toy vehicle that is capable of a wide variety of responses to such collisions should be more engaging to a user than a toy vehicle with less varied responses. A collision response may be characterized by the degree of elasticity of the collision: a highly elastic collision results in a pronounced rebound of the toy vehicle, a less elastic collision results in a less pronounced rebound. One factor affecting the elasticity of a collision of the toy vehicles described in the above-identified patents with an obstacle is the elastic characteristics of the toy vehicle tires. Pneumatic tires typically result in more highly elastic collisions, while non-pneumatic tires generally result in less elastic collisions.

BRIEF SUMMARY OF THE INVENTION

The invention is directed to a three wheeled wireless controlled toy stunt vehicle which comprises a chassis having a first major side and a second major side opposite the first major side; two independently controlled drive motors within the chassis; a battery power source connected to the chassis, the drive motors receiving power from the battery power source; two drive wheels located on opposite lateral sides of the chassis proximal one longitudinal end of the chassis, each drive wheel being operably coupled with a separate one of the two drive motors; a third wheel located at an opposite longitudinal end of the chassis generally centered with respect to a longitudinal central plane through the chassis and through the major sides of the chassis, the longitudinal central plane separating the two drive wheels from one another; and the two drive wheels and the third wheel being of a size with respect to a remainder of the vehicle such that outer perimeters of the three wheels define a volume fully enclosing the remainder of the vehicle.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
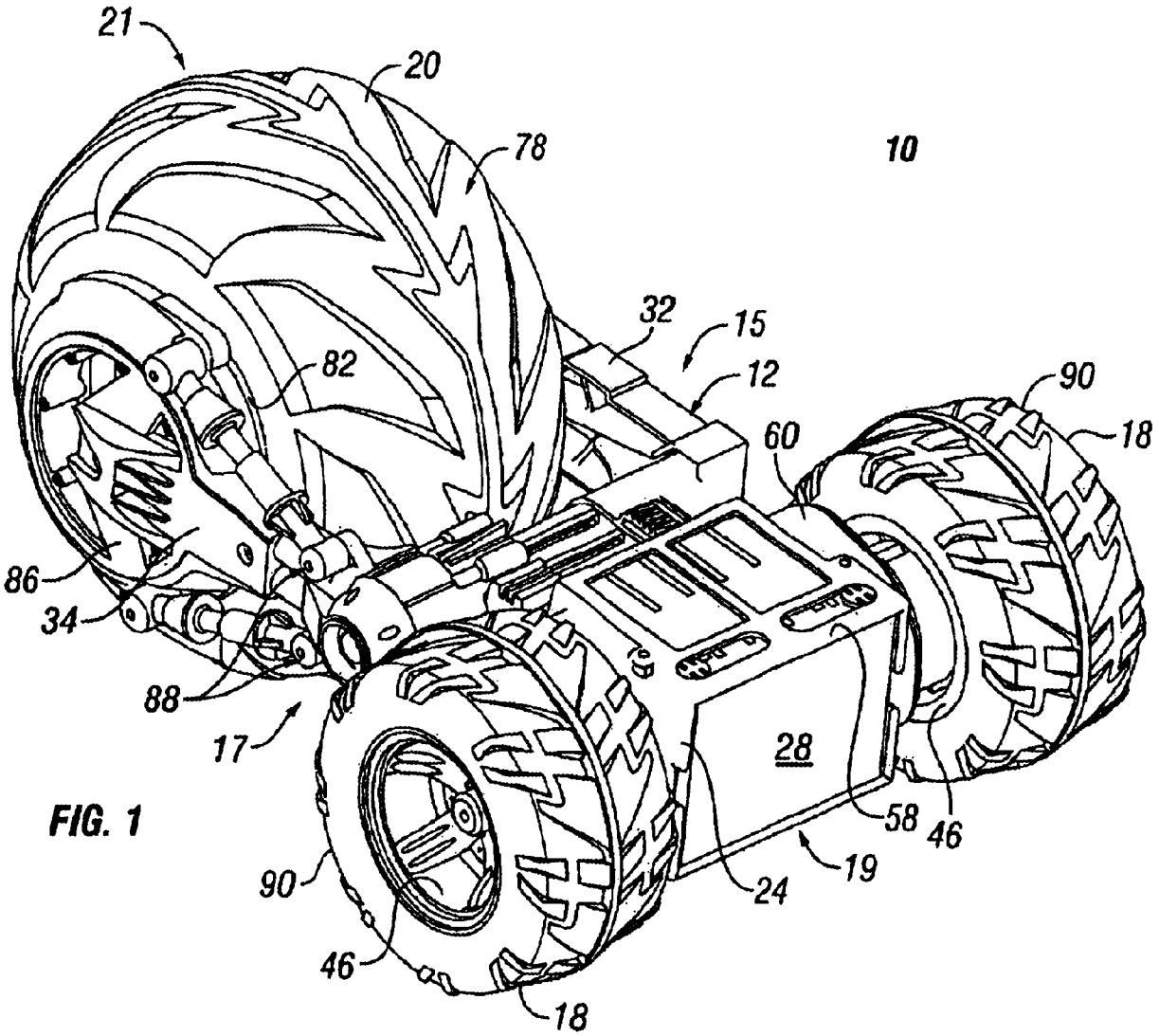
FIG. 1 is a perspective view of a three wheeled toy stunt vehicle of the present invention.
Figure 2:
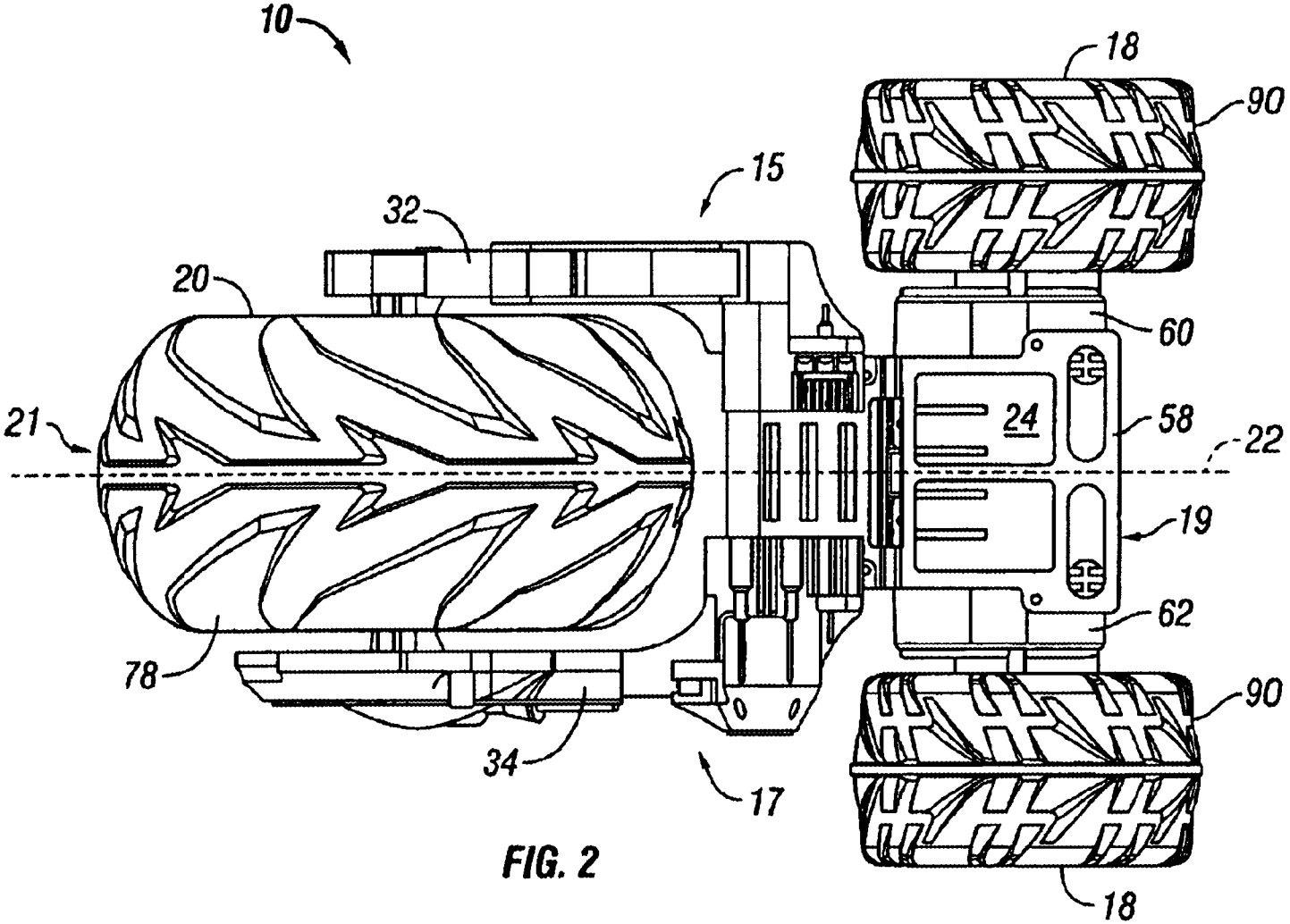
FIG. 2 is an isometric top plan view of the vehicle of FIG. 1.
Figure 4:
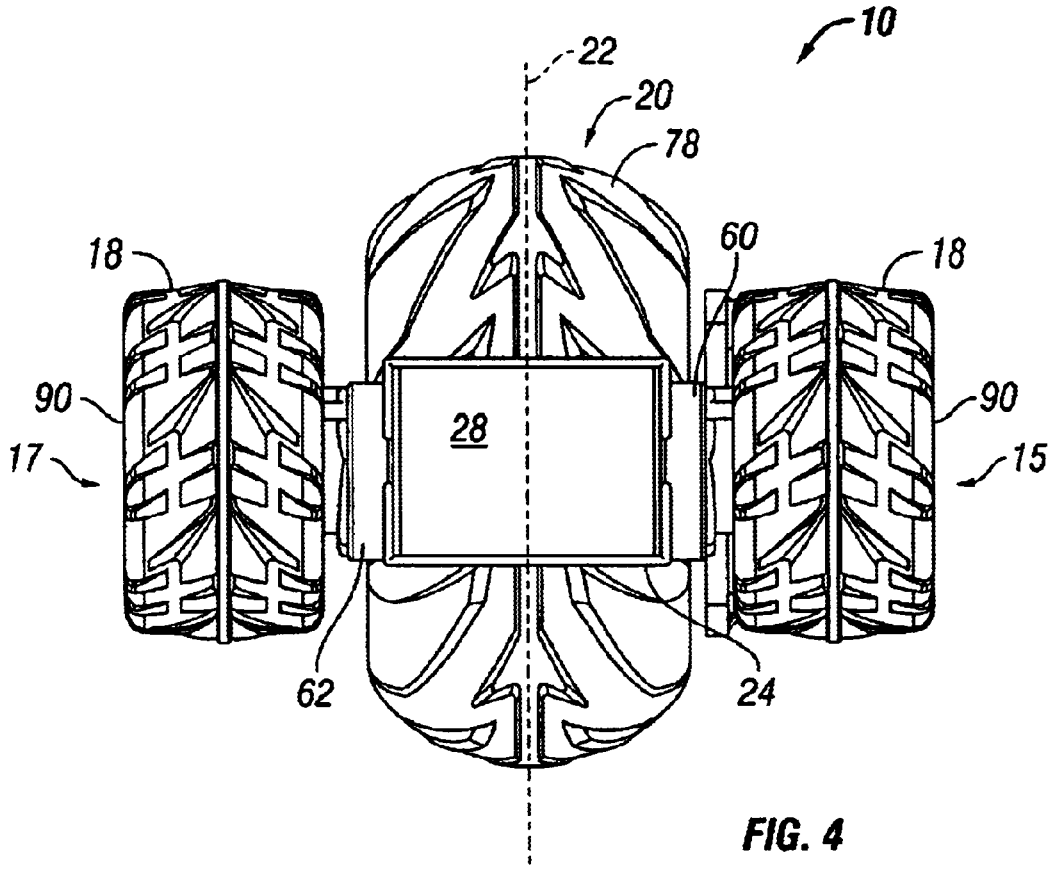
FIG. 4 is a isometric view from the right end of the vehicle of FIG. 3.

A preferred embodiment three wheeled toy stunt vehicle of the present invention is shown in the various figures and is indicated generally at 10. The vehicle 10 includes a chassis 12, with first and second major opposing sides 14 and 16, two wheels 18, each located on opposite lateral sides 15 and 17 of the chassis 12 at one longitudinal end 19 of the chassis 12, and a larger third wheel 20 located at an opposite longitudinal end 21 of the chassis 12 along a central longitudinal plane 22. The central longitudinal plane 22 extends through the chassis 12 and major sides 14 and 16, and divides the vehicle 10 in half, separating the drive wheels 18 from one another. The chassis 12 includes a main body portion 24 housing motors **26*a* and 26*b* (FIG. 5; the motors 26*a* and 26*b* are herein identified both as individual motors 26*a* and 26*b* and are also identified generically simply as 26), a preferably rechargeable battery power source 28 (FIGS. 1, 4) and control electronics (the general location 30 of which is indicated in phantom in FIG. 5). Extending outwardly from the main body portion 24 along the sides of the third wheel 20 to approximately the center of the third wheel 20 and first and second support arms 32 and 34, respectively. The arms 32, 34 support the third wheel 20 for free rotation on the chassis 12**.

Figure 3:
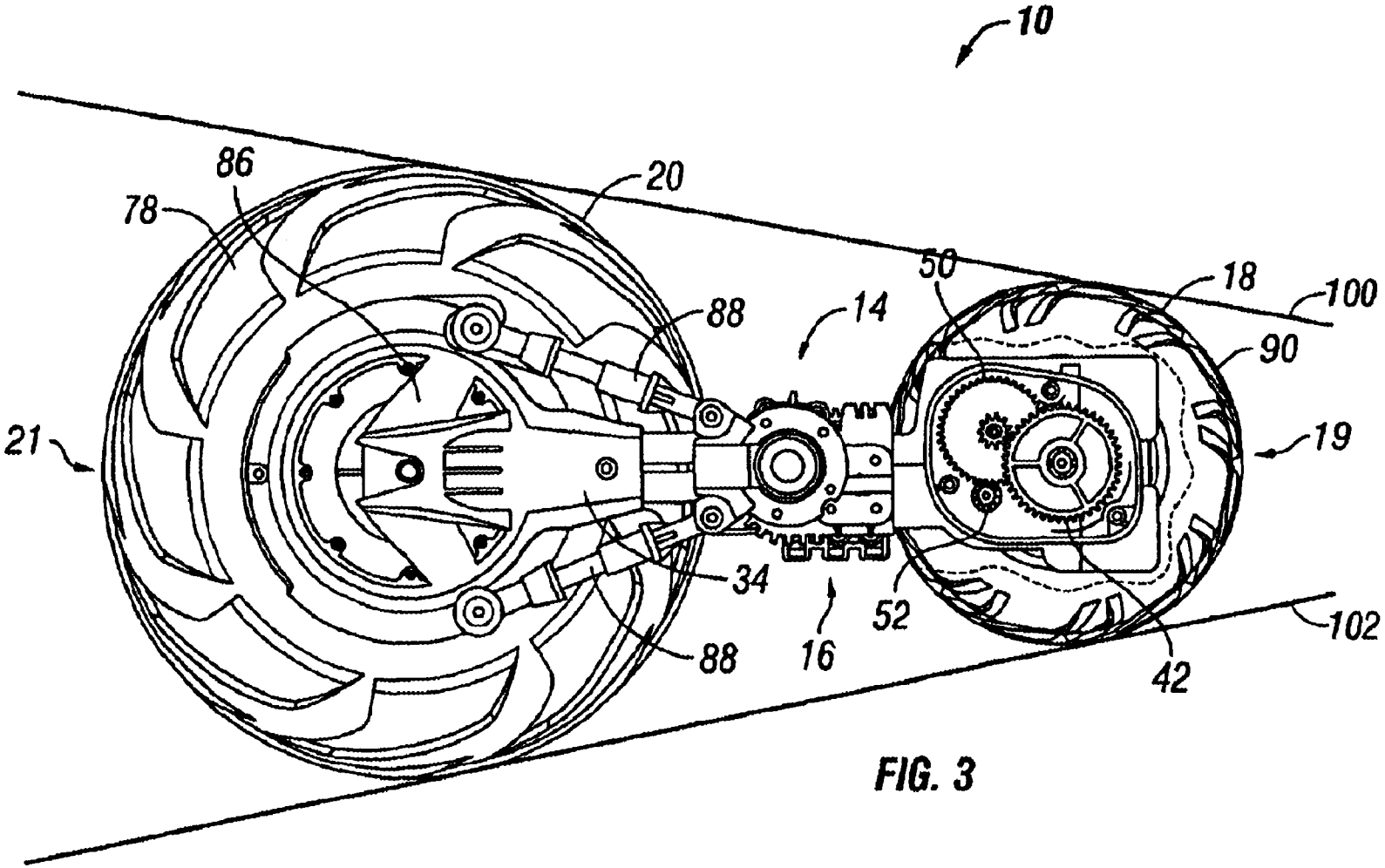
FIG. 3 is a partial broken away isometric side elevation of the vehicle of FIGS. 1 and 2.
Figure 5:
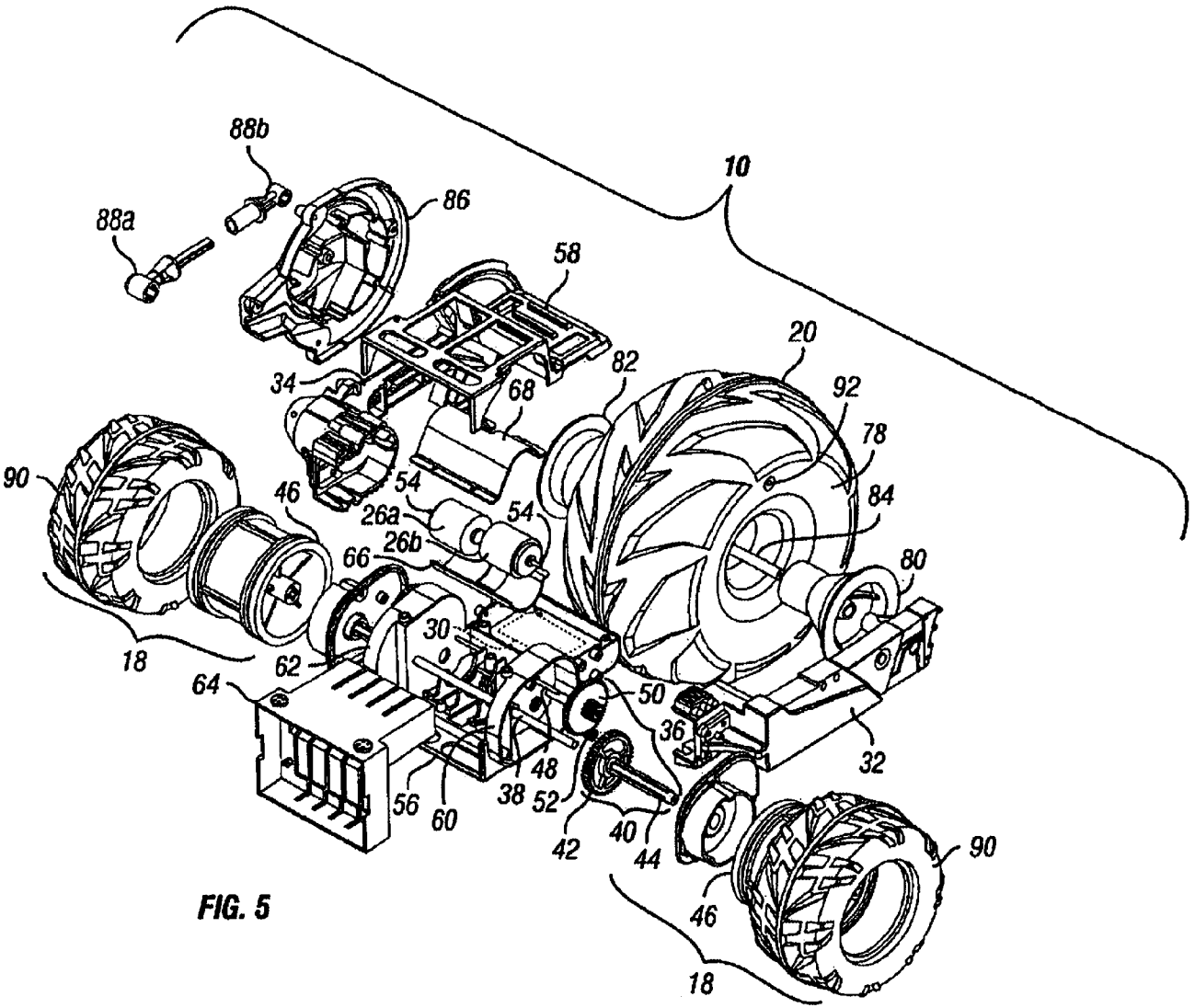
FIG. 5 is a exploded view of the vehicle of FIGS. 1–4.

Referring to FIG. 5, the vehicle 10 is shown in an exploded view. The chassis 12 includes two independently controlled preferably reversible, electric drive motors **26*a* and 26*b*, each driving a separate one of the drive wheels 18 on opposite lateral sides 15, 17 of the chassis 12. A reduction drive indicated generally at 36 operably couples one motor 26 and one drive wheel 18 and will be described with the understanding that a mirror image reduction drive 36 exists between the other motor 26 and the other drive wheel 18. An axle 38 extends transversely completely through the chassis 12 and supports at each end for free rotation a drive member 40 of each reduction drive 36. The drive member 40 includes a drive gear portion 42 and a splined shaft portion 44, which is received in the hub 46 of the drive wheel 18. A separate reduction gear axle 48 is provided in each drive train and supports a combination reduction gear 50. A motor pinion 52 is mounted on drive shaft 54 of the motor 26. The various gears of the reduction drive 36 are seen assembled in FIG. 3**.

Figure 6:
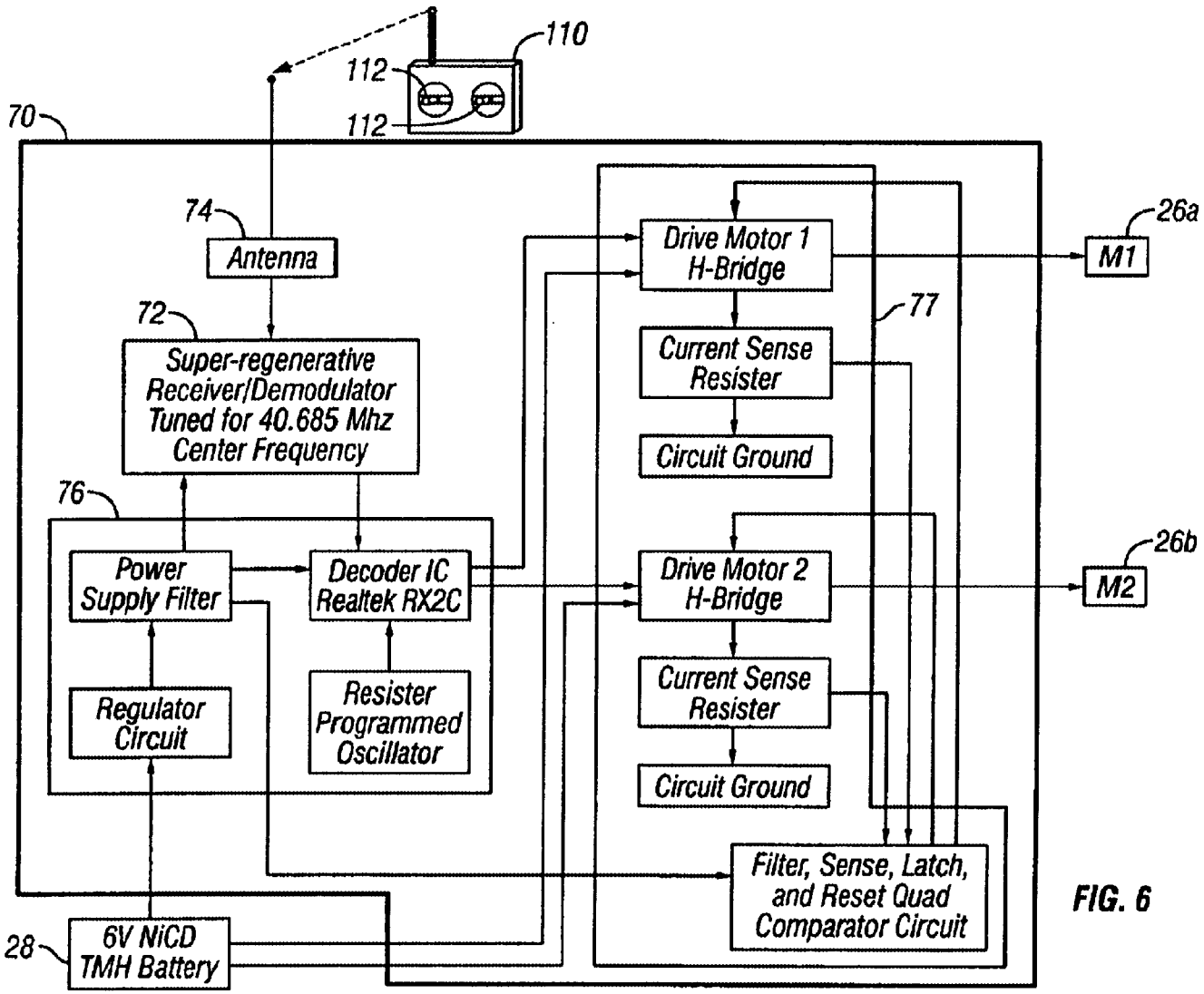
FIG. 6 is a block diagram of the electrical components of the vehicle of FIGS. 1–5.

The chassis 12 preferably is formed by a bottom housing 56, a top panel 58, a pair of mirror image gear box covers 60 and 62 and a battery box 64. Within the chassis, heat sinks 66 and 68 surround the motors 26. The location of a PCB board 70, which includes the electrical components for a radio receiver 72 and antenna 74, signal processor 76 and motor controller 77 (see FIG. 6), all of which are conventional, is indicated generally at 30. As best seen in the exploded view, the hub 46 of each drive wheel 18 is keyed to slidingly receive and engage the splines on the shaft portions 44 of the drive members 40. Arms 32, 34 extend outwardly from one end of the main body portion 24 or remainder of the chassis 12 on either side of the third wheel 20 to about the middle of the third wheel 20 to rotatably support that wheel. The third wheel 20 preferably includes a tire 78 and a pair of conical hubs 80 and 82 and is supported for free rotation between the arms 32 and 34 on axle 84. A cover 86 is provided on arm 34 for decorative purposes. A pair of "shock absorbers" 88, each formed of halves 88*a* and 88*b* (FIG. 5), are further provided on cover 86, also for decorative reasons only. Arms 32 and 34 are generally rigid so that all cushioning from impact of the third wheel 20 with an obstacle comes from the third wheel 20.

It should be noted that tires 90 of the drive wheels 18 are hollow and resilient and have an interior space open to atmosphere in order that they may resiliently collapse upon impact and absorb kinetic energy. On the other hand, the tire 78 of the larger third wheel 20 is hollow and sealed and includes a pin valve 92 operably coupled with its interior space enabling the user to adjust the pressure within that tire 78 to modify the performance of the vehicle 10.

The three wheels 18, 20 are sized with respect to the chassis 12, which is the remaining portion of the vehicle 10, such that the outermost periphery of the three wheels 18, 20 define first and second tangent planes 100 and 102 which bound the remaining portion of the vehicle 10. This permits the vehicle 10 to be operated on either of its two major sides 14 or 16. It further enables the vehicle 10 to be driven back and forth in a way that enables the chassis 12 and third wheel 20 to rotate about the drive wheels 18 and the axle 38 from one side of the drive wheels 18 to an opposing side of the drive wheels 18 thereby exposing either of the major sides 14 or 16 of the vehicle 10. It further permits the vehicle 10 to be driven on planar surfaces towards planar obstacles and rebound from those obstacles, always landing on its wheels, even when initially landing on a lateral side 15 or 17 of the vehicle 10, for continued stunt performance. Furthermore, because of the different construction of the drive wheels 18 and third wheel 20 (uninflated and inflated, respectively), the vehicle 10 will perform differently from the prior art four and six wheeled vehicles in which the wheels of the vehicle are identical to one another. The vehicle 10 may be balanced to foster movement of the third wheel 20 over the drive wheels 18. For example, the rechargeable battery power source 28 may be located at least proximal to the one longitudinal end 19 of the chassis 12 and, preferably, at the one longitudinal end 19 of the chassis 12 on an opposite side of the common axis of rotation of the drive wheels (i.e. the central axis of axle 38) from the third wheel 20. It is thus located as far away from the third wheel 20 as possible to counterbalance the weight of the third wheel 20, moving the center of gravity of the vehicle 10 longitudinally closer to axle 38. The three wheel design also adds to play value as the longitudinal end 19 with the third wheel 20 effectively has only a central area of contact which is relatively narrower than that of the opposite end 17 with the two spaced areas of contact provided by drive wheels 18. There is a greater tendency for the vehicle 10 to rotate in its major plane (i.e. horizontal plane between major sides 14, 16) when the third wheel 20 strikes an obstacle in other than a perpendicular orientation to the obstacle than if the drive wheels 12 were to strike the same obstacle. The rebounding characteristics can further be changed by varying the pressure of the tire of the third wheel 20.

The vehicle 10 is used with a hand operated remote control unit 11 (typically having a pair of manual controls 112, one for each motor, and control and radio transmission circuitry, which is conventional as shown in U.S. Pat. No. 5,667,420. Independent motor control permits "tank steering" of the vehicle including the ability to essentially spin in place about an axis centered between the drive wheels 18 due to the balance of the vehicle.

The tires 90 of the drive wheels 18 are preferably formed from Kraton™ rubber (a styrene-butadiene-styrene polymer) and the tire 78 of the third wheel 20 is preferably formed from natural rubber. The chassis 12 components, including the support arms 32, 34, the bottom housing 56, the top panel 58, the gear box covers 60 and 62, and the battery box 64 are preferably formed from ABS plastic. Likewise, the hubs 46 of the drive wheels 18 and the conical hubs 80, 82 of the third wheel 20 are preferably formed from ABS plastic. All of these aforementioned plastic components are preferably formed by injection molding techniques well known to those skilled in the art. From this disclosure, it would be obvious to one skilled in the art to substitute other materials (e.g., other plastics, rubber, or metal) and other fabrication techniques (e.g., machining or stamping) for the materials and fabrication techniques preferably used. Similarly, from this disclosure, it would be obvious to one skilled in the art to substitute other proportions (e.g., a wider or longer toy vehicle 10) for those shown in the preferred embodiment.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A three wheeled wireless controlled toy stunt vehicle comprising:

a chassis having a first major side and a second major side opposite the first major side, the chassis further including a main body portion supporting two drive wheels with at least one arm projecting from the main body portion and supporting a third wheel for free rotation;

two independently controlled drive motors within the chassis; and a battery power source connected to the chassis, the drive motors receiving power from the battery power source;

the two drive wheels located on opposite lateral sides of the chassis proximal one longitudinal end of the chassis, each of the drive wheels being operably coupled with a separate one of the two drive motors;

the third wheel being located at an opposite longitudinal end of the chassis generally centered with respect to a longitudinal central plane through the chassis and through the major sides of the chassis, the longitudinal central plane separating the two drive wheels from one another; and the drive wheels and the third wheel being of a size with respect to a remainder of the vehicle such that outer surfaces of the drive wheels and of the third wheel contact a supporting surface when the toy vehicle is oriented with either the first major side or the second major side facing toward the supporting surface.

2. The toy stunt vehicle of claim 1 wherein the third wheel has a diameter that is larger than a diameter of either of the two drive wheels.

3. A three wheeled wireless controlled toy stunt vehicle comprising:

a chassis having a first major side and a second major side opposite the first major side;

two independently controlled drive motors within the chassis;

a battery power source connected to the chassis, the drive motors receiving power from the battery power source;

a radio receiver;

a signal processor circuit and a motor controller circuit operably coupled with one another and the radio receiver and operably coupling each of the drive motors with the battery power source;

an antenna operatively coupled to the radio receiver;

two drive wheels located on opposite lateral sides of the chassis proximal one longitudinal end of the chassis, each of the drive wheels being operably coupled with a separate one of the two drive motors; and a third wheel locate at an opposite longitudinal end of the chassis generally centered with respect to a longitudinal central plane through the chassis and through the major sides of the chassis, the longitudinal central plane separating the two drive wheels from one another;

the drive wheels an the third wheel being of a size with respect to a remainder of the vehicle such that outer surfaces of the drive wheels and of the third wheel contact a supporting surface when the toy vehicle is oriented with either the first major side or the second major side facing toward the supporting surface.

4. A three wheeled wireless controlled toy stunt vehicle comprising:

a chassis having a first major side and a second major side opposite the first major side;

two independently controlled drive motors within the chassis;

a battery power source connected to the chassis, the drive motors receiving power from the battery power source;

two drive wheels located on opposite lateral sides of the chassis proximal one longitudinal end of the chassis, each of the drive wheels being operably coupled with a separate one of the two drive motors; and a third wheel located at an opposite longitudinal end of the chassis generally centered with respect to a longitudinal central plane through the chassis and through the major sides of the chassis, the longitudinal central plane separating the two drive wheels from one another;

the drive wheels an the third wheel being of a size with respect to a remainder of the vehicle such that outer surface of the drive wheels and of the third wheel contact a supporting surface when the toy vehicle is oriented with either the first major side or the second major side facing toward the supporting surface; and wherein the third wheel includes a hollow tire defining an interior space, the interior space being sealed and pressurized.

5. The toy stunt vehicle of claim 4 wherein the drive wheels are hollow, defining an interior space within the drive wheels, the interior space of the drive wheels being vented to atmosphere.

6. The toy stunt vehicle of claim 4 further comprising a valve operably coupled with the tire of the third wheel to adjust pressure within the tire of the third wheel.

7. A three wheeled wireless controlled toy stunt vehicle comprising:

a chassis having a first major side and a second major side opposite the first major side;

two independently controlled drive motors within the chassis;

a battery power source connected to the chassis, the drive motors receiving power from the battery power source;

two drive wheels located on opposite lateral sides of the chassis proximal one longitudinal end of the chassis, each of the drive wheels being operably coupled with a separate one of the two drive motors; and a third wheel locate at an opposite longitudinal end of the chassis generally centered with respect to a longitudinal central plane through the chassis and through the major sides of the chassis, the longitudinal central plane separating the two drive wheels from one another;

wherein the drive wheels and the third wheel are of a size with respect to a remainder of the vehicle such that outer surfaces of the drive wheels and of the third wheel contact a supporting surface when the toy vehicle is oriented with either the first major side or the second major side facing toward the supporting surface; and wherein the battery power source is located at least proximal the one longitudinal end of the chassis.

8. The toy stunt vehicle of claim 7 wherein the drive wheels are mounted to rotate along a common axis and wherein the battery power source is located at the one longitudinal end on a side of the common axis opposite from the third wheel.

9. A combination comprising a remote control unit having manually-operated control elements and a three wheeled wireless controlled toy stunt vehicle, the vehicle including:

a chassis having a first major side and a second major side opposite the first major side;

two independently controlled drive motors within the chassis;

a battery power source connected to the chassis, the drive motors receiving power from the battery power source;

a radio receiver configured to received command signals from the remote control unit;

a signal processor circuit and a motor controller circuit operably coupled with one another and the radio receiver and operably coupling each of the drive motors with the battery power source;

an antenna operatively coupled to the radio receiver;

two drive wheels located on opposite lateral sides of the chassis proximal one longitudinal end of the chassis, each of the drive wheels being operably coupled with a separate one of the two drive motors; and a third wheel located at an opposite longitudinal end of the chassis generally centered with respect to a longitudinal central plane through the chassis and through the major sides of the chassis, the longitudinal central plane separating the two drive wheels from one another;

wherein the drive wheels and the third wheel are of a size with respect to a remainder of the vehicle such that outer surfaces of the drive wheels and of the third wheel contact a supporting surface when, the toy vehicle is oriented with either the first major side or the second major side facing toward the supporting surface; and wherein manipulation of the control elements produces a predictable and repeatable effect on the drive motors and the toy vehicle.

* * * * *